United States Patent [19]

Miller

[11] 4,102,385

[45] Jul. 25, 1978

[54] WINDOW SHADE

[75] Inventor: Gerald W. Miller, Cincinnati, Ohio

[73] Assignee: Clopay Corporation, Cincinnati, Ohio

[21] Appl. No.: 799,350

[22] Filed: May 23, 1977

[51] Int. Cl.[2] ..... A47G 5/02

[52] U.S. Cl. ..... 160/263

[58] Field of Search ..... 160/263, 250, 323 R–326, 160/89 R

[56] References Cited

U.S. PATENT DOCUMENTS

| | | | |
|---|---|---|---|
| 3,203,468 | 8/1965 | Gossling et al. | 160/263 |
| 3,299,944 | 1/1967 | Gossling et al. | 160/263 |
| 3,913,655 | 10/1975 | Ogino | 160/84 R |
| 4,006,770 | 2/1977 | Ferguson | 160/263 |

*Primary Examiner*—Peter M. Caun

*Attorney, Agent, or Firm*—Wood, Herron & Evans

[57] ABSTRACT

This invention is directed to a window shade assembly including a telescoping roller and a shade mounted on the roller which may be quickly and easily adjusted to conform to the size of the window opening into which the assembly is to be mounted. The shade at one end includes a first portion secured to the larger roller section and a second portion wrapped around the projecting end of the smaller roller section a number of times sufficient to form a tube having an outside diameter approximately equal to the outside diameter of the first roller section. The projecting smaller roller section is freely axially slidable within the tube. In accordance with a preferred form of the invention disclosed, the shade includes at the side adjacent the smaller roller section a plurality of spaced hand-strip lines, preferably invisible, extending from end-to-end parallel to the shade edge which permit hand-stripping of discrete widths of the shade while the shade is rolled on the roller. In accordance with the invention disclosed, the window shade assembly is conveniently sized merely by severing the shade material at a desired shade width and adjusting the telescoping roller to conform to the desired width.

5 Claims, 7 Drawing Figures

WINDOW SHADE

BACKGROUND OF THE INVENTION

This invention relates to a window shade and, more particularly, to a window shade assembly including a telescoping roller.

The number of sizes of window openings into which window shades must be fitted is limitless. Practically, all shades will be in the range of 25 to 72 inches; but there are window openings for every dimension within that range, and in older houses, the window openings are frequently less than 25 inches wide. In the application of shades to windows, these shades must conform to the window size rather than the window size conforming to the available size of shade manufactured. This is true not only for newly constructed buildings, but obviously also for those buildings which were erected many years ago. For these reasons, when a customer wants a shade, it is common practice to select an oversized shade and to cut its length to the size of the window opening into which the shade is to be mounted.

One type of shade roller now being manufactured includes a solid wooden roller or hollow metal roller having a spring motor connected between the roller and spear which is fixed against rotation in a slotted bracket. The other end of the roller has a cap containing a gudgeon pin which is fixed to the cap and which is adapted to be rotatably mounted in a bracket. A principal outlet for shades of this type and the place in which most of the cutting to size is performed is the variety, discount or department store. The cutting of the shade to size in such an establishment is at best an annoying undertaking.

The window shades described and disclosed in the U.S. Pat. Nos. 3,203,468; 3,299,944; and 3,580,323; all assigned to the assignee of this invention, provide improvements over prior art shades and methods of sizing. These shades comprise two sections, one being telescopable into the other for supporting the shade material so that the shortening of the shade can be effected merely by cutting the shade material and the slat running through the hem pocket, sliding the cut material from the roller, and telescoping the projecting portion of the roller into its adjoining section. Shades of this type have eliminated much of the odium theretofore attending shade shortening by providing an assembly which can be simply shortened by telescoping one section of the shade roller into another section.

All of the window shades described in the above patents offer significant improvements over prior devices with respect to the simplicity with which the shade can be shortened and the aesthetic appeal of the shade arising from elimination of any drooping or wrinkling of the shade material. However, in each form, it is necessary to provide an interposed tube of paper or other cuttable material surrounding at least the projecting end of the smaller roller section to which the shade is adhesively secured. This is true even in window shades which are hand-strippable such as that described and disclosed in copending application U.S. Ser. No. 785,368, assigned to the assignee of this invention.

SUMMARY OF THE INVENTION

It has been an objective of the present invention to provide a window shade having the advantages of the window shades described above but which eliminates the necessity of the tube surrounding the telescoping roller. Elimination of this tube results in significant savings in the cost of manufacture of the window shade and, furthermore, simplifies the method for accommodating the shade to window openings of various sizes. That is, it has been an objective of the present invention to provide a window shade assembly including a telescoping roller assembly which eliminates much of the odium heretofore attending shade cutting and which also permits the window shade to hang without drooping or wrinkling but without the need for the manufacture and assembly of a tube to be interposed between the telescoping roller and the shade material. In this regard, it has been a further objective of this invention to eliminate the need for any gluing, adhering or other fixation of the shade end to the telescoping end of the roller heretofore required to prevent drooping or wrinkling of the shade material. The window shade assembly of the present invention may therefore be more inexpensively manufactured and more easily sized.

The present invention consists of a unique article for accommodation of window openings of various sizes which overcomes the problems heretofore associated with the prior art shades mentioned above. In accordance with the principles of the invention, the window shade assembly comprises a telescoping roller assembly including a larger roller section and a smaller roller section telescopingly seated therein with an axially projecting portion, and a window shade of flexible sheet material. The window shade at its end adjacent the roller includes a first portion which is secured to the first roller section, e.g., by an adhesive strip, and a second portion which is wrapped around the projecting portion of the second roller section a number of times sufficient to form a tube having an outside diameter approximately equal to the outside diameter of the second roller section. The second shade portion is not secured to the smaller roller section or to itself but rather is held in place only by frictional engagement of the overlapping wrapped layers, and the smaller roller section is freely axially slidable within the tube formed thereby. Unexpectedly, in this arrangement, the securement of the first shade portion only to the larger roller section provides support for the shade across its entire width.

The wrapping of the second portion about the projecting smaller roller section eliminates the problem of drooping or wrinkling of the shade associated with telescoping shade roller sections. That is, in telescoping roller window shade assemblies, the upper or inner edge of the shade material must be secured to the telescoping shade roller along its entire length in order for the shade to hang properly. If the shade were attached only to the larger roller section, the unattached side of the shade would tend to droop and would be unattractive in appearance. The shade cannot be attached to both sections of the shade roller for then the smaller roller section cannot telescope freely into the other. Finally, the shade cannot be initially attached to the larger roller section and then subsequently attached to the smaller roller section after sizing of the shade and adjustment of the roller for then the shade droops down over the step formed by the end of the larger section. This drooping on rolling of the shade on the roller causes a large wrinkle in the shade material running from end-to-end which is unattractive in appearance. The provision of the fixed tube in the window shade assemblies disclosed in the aforementioned patents with the shade material attached prevents the shade material from drooping along the side depending from the smaller roller section while permitting free sliding of the smaller roller section in the tube such that when the shade material and tube are cut the tube can be slid from the roller and the smaller roller section telescoped to conform to the adjusted width of the shade.

This invention, however, eliminates the need for any interposed tube and further eliminates the need for adhering or otherwise fixing the shade to the smaller roller section or, in the preferred form, to itself whereby the window shade may be more inexpensively manufactured and easily sized. Futhermore, according to this invention, the shade may be easily sized without unrolling of the shade material from the roller and the sized shade has a smooth, straight edge and hangs without drooping or wrinkling.

The roller upon which the shade material is mounted may take several forms. For instance, the roller may simply comprise a larger metal tubular member with a wooden dowel or plastic cylinder forming the second telescoping member. With a wooden dowel, the dowel may be held in the metal roller by dimples which are depressed in the surface of the metal roller a distance sufficient to cut into the soft wooden dowel as it is forced into the metal roller. With an all metal roller, the roller sections may be conveniently provided with longitudinal grooves into which the members are keyed. The cooperation between the grooves prevents relative rotation of the two members. The telescoping roller may further comprise motor and pin end mounting means which are adapted for end mounting. These forms and other forms of this invention will be discussed in more detail later in this description.

In the general aspect, this invention provides a window shade including a telescoping roller assembly and a shade secured thereto. The steps required to size the shade include simply separating a portion of the side of the shade adjacent the smaller roller section from the balance of the shade at a desired shade width, removing the separated excess shade material from the roller, e.g., by sliding it off the end of the smaller roller section, and telescoping the smaller roller section to conform to the width of the sized shade. The improvement of which the present invention represents over past structures can be perceived by noting the simplicity with which a shade of the present invention can be adjusted to a desired width. In any of the past structures, it was always necessary to cut or otherwise separate a section of the roller tube after cutting of the shade material and then slide the tube off the telescoping roller. Even in shades which are hand-strippable by the consumer in the home, such as that described in the aforementioned patent application, it is necessary to separate the tube prior to adjustment of the telescoping roller. In contrast, the window shade of the present invention is sizable in essentially two simple steps: cutting through the shade material to the roller and pushing the smaller roller section into the larger roller section.

In one presently preferred form of the invention, the window shade assembly is made hand-strippable, such that it may be sized by the consumer in the home without the need for cutting instruments, by providing the side of the shade adjacent the smaller roller section with a plurality of spaced, hand-strip lines extending from end-to-end, i.e., from top-to-bottom, substantially parallel to the shade edge. The strip lines permit hand-stripping of discrete predetermined widths of the shade while the shade is rolled on the roller without cutting of the shade material. According to this form of the invention, the shade may be adjusted to a desired width without unrolling of the shade material simply by hand-stripping and unwinding the excess width of shade material, and thereafter pushing the smaller roller section into the larger section to conform to the desired width.

In summary, the window shades of the present invention overcome the disadvantages associated with known shades heretofore described by providing a window shade assembly including a telescoping roller wherein securement of the first shade portion only to the larger roller section provides support for the shade across its entire width. Quite unexpectedly, it has been found that the attachment of the shade to the roller in this manner not only does not interfere with telescoping of the roller sections but also effectively fixes the shade material to the telescoping roller sections across the entire shade width eliminating any drooping of the shade material from along the side depending from the smaller roller section. The present invention eliminates the cost of manufacture and assembly of the tube found in prior art telescoping roller and shade assemblies of the non-drooping type and, in addition, the cost associated with fixing the shade to the smaller roller section and permits sizing of the shade in fewer steps while still eliminating any drooping, wrinkling, etc. of the shade material. These and other advantages of the invention will be further appreciated by reference to the following detailed description of the invention and the accompanying drawings.

DETAILED DESCRIPTION OF THE INVENTION

Figures 1, 2, 3, 4:
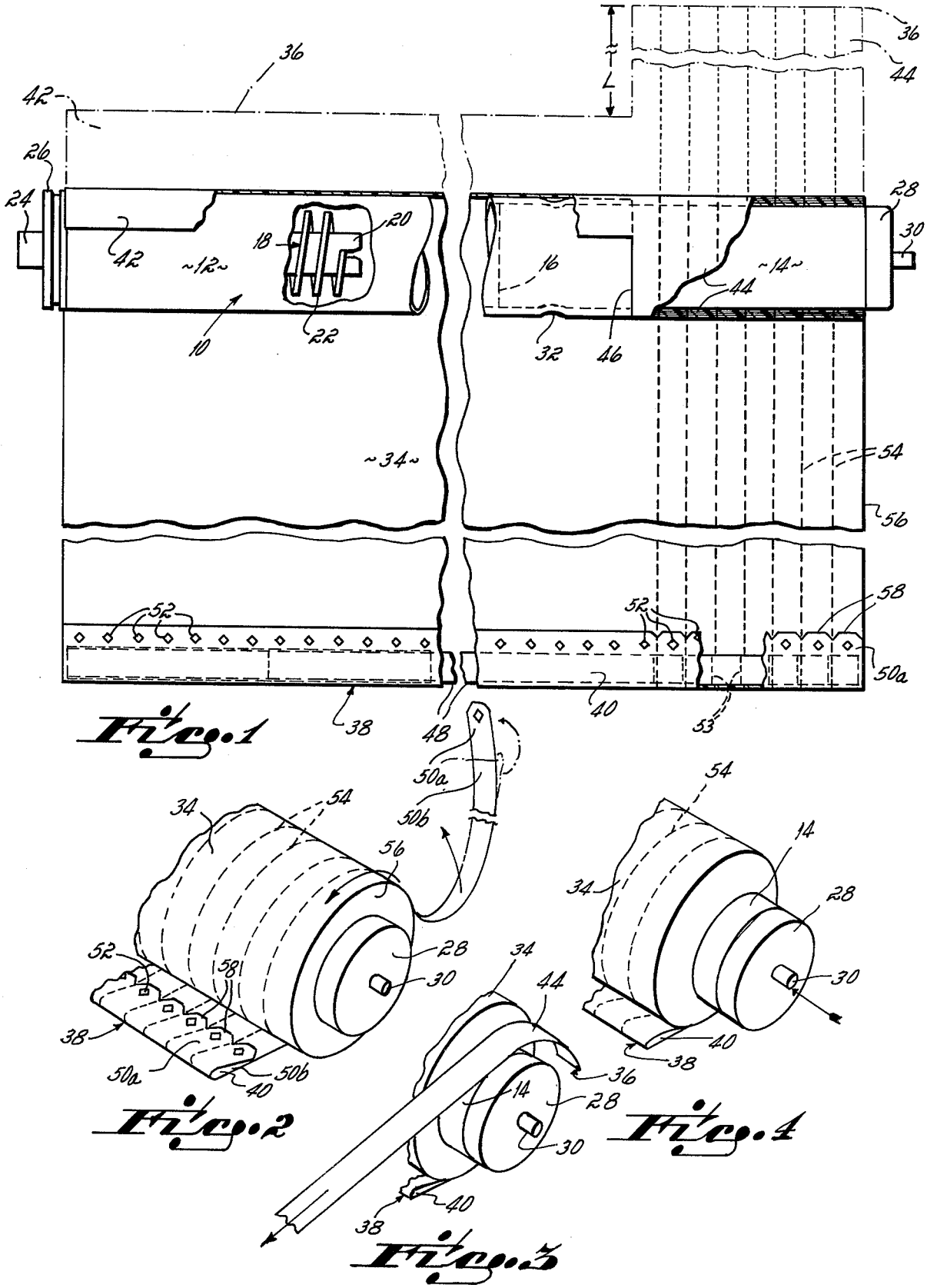
FIG. 1 is an elevational view, partly in section, showing a preferred form of the invention.
FIGS. 2 through 4 are pictorial views illustrating the steps of sizing a shade in accordance with the present invention.

Referring to FIG. 1, the window shade assembly includes a telescoping roller 10 including a first tubular roller section 12 and a second section 14 having one end 16 thereof telescopingly seated within the first section 12. The left end of the roller 10, as viewed in FIG. 1, is adapted to receive a spring motor 18 which includes a torque rod 20 connected to one end of a rewind spring 22. The torque rod 20 is fixed to a spear 24 which projects from the left end of the roller 10 and is engageable with a flat slot of a window shade bracket by which the window shade is supported in the window opening. A cap 26 encloses a clutch or other operating mechanism (not shown) through which the spring and torque rod are connected to the roller to rotate the roller in winding the shade on the roller 10. At the right hand end of the shade, the roller 10 is adapted to receive a pin end plug or cap 28. Projecting from the pin end cap 28 is a cylindrical gudgeon pin 30 which is engageable with and rotates in the other of the window brackets supporting the window shade in the window opening.

The particular means by which the telescoping second section 14 is seated in the first section 12 is not critical. For example, for a metal tubular first member and a wooden dowel or plastic cylinder forming the second member, the dowel may be held in the steel roller principally by dimples 32 which are depressed into the surface of the metal roller a distance sufficient to cut into the soft wooden dowel as it is forced into the metal roller. The dimples 32 prevent both axial and rotative movement of the second member with respect to the first. With an all metal roller, a convenient form of mounting is that described in U.S. Pat. No. 3,203,468, particularly in relation to FIG. 10, wherein the smaller roller formed from sheet metal is seamed to provide a longitudinal groove adjacent the seam into which the seam of the larger roller member is keyed. The cooperation between the seam and the groove prevents relative rotation of the two roller members.

A shade 34 of a flexible sheet material such as cloth or a vinyl plastic has a first end 36 adjacent the roller assembly and an opposite or free end 38 at which a hem pocket 40 is formed. The shade 34 is attached to the larger roller section 12 along a first portion 42 of the end 36, the width of which is equal to the length of the larger roller section 12. The particular method of attachment is not critical and a suitable method is by means of an adhesive strip as disclosed in U.S. Pat. No. 2,599,410. Alternatively, the shade could be attached in other known ways.

The shade 34 at the side adjacent the smaller roller section 14 includes a second portion 44 which is an extended length of the shade material 34 (as shown in phantom in FIG. 1) and which has a width corresponding to the length of the roller section 14 projecting from the larger section 12. This portion of the shade 34 is rolled about the projecting portion of the smaller roller section 14 a number of times sufficient to form in effect a tube having an outside diameter approximately equal to the outside diameter of the first roller section 12. That is, the shade portion 44 is of such length L that when wrapped about the smaller roller second section 14 there is formed a substantially smooth transition between the end 46 (opposite the cap 26) of the larger section 12 and the surface of the tube formed by the wrapping of the shade portion 44.

Thus, the length L of the shade portion 44 is determined by the difference between the outside diameters of the roller sections 12 and 14 and the thickness of the shade material 34. For example, in a window shade assembly including a telescoping roller having an outside diameter of the larger section of about 1 inch and an outside diameter of the smaller section of about 0.875 inches and a shade material of about 5½ to 6 mils in thickness, the length L would be about 6 to 9½ inches, and the material would be wrapped about 2 to 3 times around the smaller roller section.

The end portion 44 wrapped about the projecting roller section 14 is not otherwise secured thereto and therefore does not interfere with the free axial telescoping of the roller section. The adhesive securing the shade 34 to the first roller section 12 holds the shade in proper position with respect to the first roller section 12 so that the wrapping of the shade portion 44 forms in effect an extension of the first member 12 which prevents any wrinkling of the shade material. The adhesive prevents the wrapped portion 44 of the shade from rotating with respect to the first member 12 and limits unrolling of the shade.

In a preferred form of the invention, as illustrated in FIG. 1, the wrapped portion 44 of the shade is not secured to itself. Rather, the overlapping wrapped layers frictionally engage one another to prevent drooping of the shade portion depending from the projecting roller end. However, it will be recognized that any of the overlapping wrapped layers may be joined one to another, if desired, without departing from the present invention. For example, if desired, the outer two layers of wrapped shade material may be joined by known means such as adhesively or by an ultrasonic or dielectric device. If a plastic roller and plastic shade material are employed, it will be recognized that the end portion 42 could be secured to the layer roller section 12 along an axially extending line with the joining line continuing across the width of the wrapped section 44 thereby joining the outer two wrapped layers.

At the free end 38 of the shade 34 is the hem pocket 40 into which a hem stick 48 is inserted for grasping for raising and lowering the shade. The hem pocket 40 is formed by joining overlapping portions **50*a*, 50*b* of the shade at spaced points 52. Alternatively, the overlapping portions 50*a*, 50*b* could be joined by a continuous line, e.g., by stitching in the case of cloth shades or heat sealing in the case of a plastic shade material. Preferably, the hem stick 48 is telescoping. However, it may include spaced perforations, serrations or the like (shown in phantom at 53**) providing lines of weakness to permit the convenient breaking off of excess slat length on sizing of the shade.

Sizing the shade to a desired width is easily accomplished simply by sliding the hem stick out of the hem pocket, marking the desired width of the shade and cutting through the shade material to the roller section 14 at the mark. The cutting may be accomplished on a known rotary shade cutting machine or with the use of a razor blade or the like. Cutting continues until the blade edge reaches the roller section 14. At that point, the severing is complete and the excess shade material may be simply slid off the roller end. The roller section 14 is then telescopingly adjusted to conform to the width of the shade simply by pushing the smaller section 14 into the larger section 12. The hem stick is likewise adjusted and slid back into the hem pocket.

In a preferred form of the invention, the shade at its one side adjacent the roller section 14 includes a plurality of spaced, hand-strip lines 54 permitting the window shade assembly to be sized by the consumer in the home without the use of machines or other cutting elements. The hand-strip lines 54 extend from one end, i.e., the free end 38 of the shade to the opposite end 36 including along the second portion 44 of the shade. The lines are substantially parallel to the edges 56 of the shade and are separated by predetermined distances to permit decreasing of shade width by any amount up to the total or sum of the separations. For example, the shade may conveniently be formed with 24 strip lines separated by one-half inch increments thus permitting sizing of the shade width from one-half inch up to 12 inches. In this form of the invention, the attachment points 52 forming the hem pocket 40 are spaced at points intermediate the hand-strip lines 54 and continue on at equally spaced intervals for the remainder of the shade width.

The particular manner of forming the strip lines in the shade is not critical to the invention and may comprise any of a number of known methods of weakening material along a line permitting hand-stripping of the material along the line while leaving a smooth, straight edge. For example, in woven shades, the strip lines may be formed during the weaving process by some means of fiber orientation or thereafter by perforating or serrating the shade material along a line. In shades formed of plastic material, the lines may be formed by weakening the material along a line or by such mechanical means as perforating or serrating or by cutting to decrease the thickness of shade material along continuous lines. Although any means is suitable when a smooth shade material is provided, it is desirable that the lines be invisible to maintain the aesthetic appeal of the shade. When the shade material is patterned or embossed, the lines may form a part of the pattern and thus, even though visible, do not noticeably affect the aesthetics of the shade.

Preferably, the hem end is provided with a plurality of integral, contoured tabs 58 the edges of which substantially coincide with the strip lines 54 to facilitate hand-stripping, as disclosed in my copending patent application U.S. Ser. No. 732,715, also assigned to the assignee of this invention, which is incorporated herein by reference. Preferably the tabs are on the back side of the shade so as to be out of view.

In sizing the shade of this form of the invention to the desired width only a few simple steps are required. The desired shade width is marked by measuring the window opening or by placing the rolled-up shade against the window opening to determine the strip line along which the excess shade material is to be stripped. The hem stick is slid axially out of the pocket a distance sufficient to allow the excess shade material to be stripped. With the shade in the rolled condition, the appropriate tab 58 is grasped and pulled to separate the overlapping portions 50*a*, 50*b* and initiate stripping along the marked strip line. As shown in FIG. 2, stripping commences at the free end 38 of the shade and proceeds by unwinding the shade material with the material following the strip line until it reaches the roller section 14. This operation can be done quite rapidly. When the end of the shade portion 44 is reached, the excess shade material is totally separated from the balance of the shade from the roller (FIG. 3). The last step required is illustrated in FIG. 4 and consists of merely pushing the second section 14 into the hollow first section 12. The force required to push the second section into the first is slight enough to be done by hand. The roller is thus conformed to the stripped width of the shade. The telescoping hem stick is now likewise conformed to the stripped width of the shade and is replaced in the hem pocket.

Figure 5:
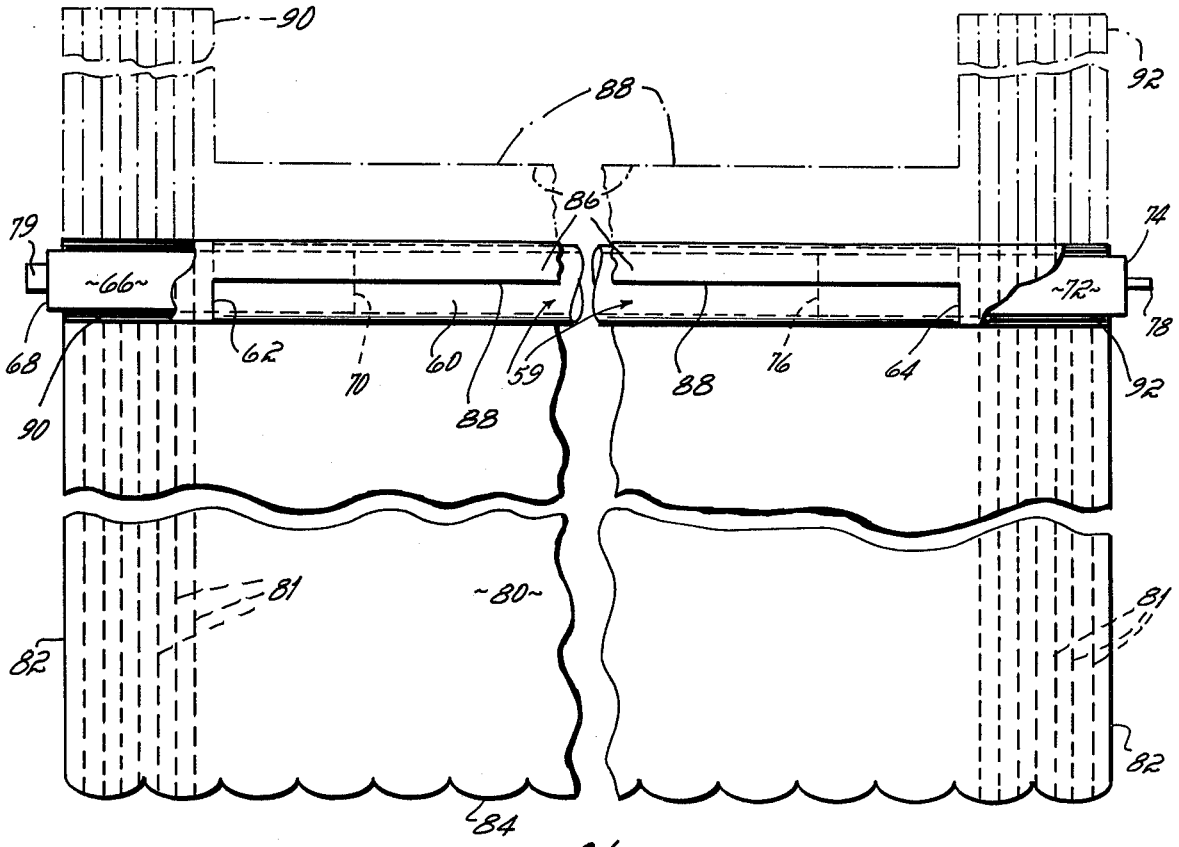
FIG. 5 is an elevational view, partly in section, showing another embodiment of the invention.

In the embodiment shown in FIG. 5, there is provided a window shade assembly in accordance with the principles of this invention having provisions for permitting the assembly to be shortened and conformed to the size of the window opening into which the assembly is to be mounted while maintaining the transverse symmetrical design of the shade. This embodiment employs a telescoping roller 59 including a larger tubular roller section 60 having open ends 62 and 64, a first smaller tubular roller section 66 having a motor receiving end 68 and an opposite end 70 telescopingly seated within the end 62 of the larger roller section 60, and a second smaller tubular roller section 72 having a pin receiving end 74 and an opposite end 76 telescopingly seated within the end 64 of the larger roller section 60. Again, the roller members are so constructed as to prevent relative rotative movement between the first and second smaller roller sections, respectively, and the larger roller section 60. Further, the end 74 of the second roller section 72 carries a conventional gudgeon pin 78 and the end 68 of the first roller member 66 has the usual flat spear 79 by which the assembly may be mounted in conventional window shade brackets.

As further shown in FIG. 5, the shade 80 at its lateral edges 82 is provided with spaced hand-stripped lines 81 extending from end-to-end substantially parallel to the edges 82 of the shade. The shade 80 further includes a free end 84 which, in the embodiment shown in FIG. 5, is in the form of a transversely symmetrical scalloped design and an opposite end 86 secured to the telescoping roller assembly 59. The secured end 86 of the shade includes a center portion 88 which is secured to the larger roller section 60 across its width, e.g., by means of adhesive securement heretofore described. The end 86 of the shade 80 further includes first and second side portions 90 and 92, respectively, of an extended length of shade material 80 (as shown in phantom in FIG. 5) which have a width corresponding to the length of the roller sections 66 and 72 projecting from the larger roller section 60. These portions 90 and 92 of the shade 80 are rolled about the projecting portions of the smaller roller sections 66 and 72, respectively, a number of times sufficient to form in effect tubes having an outside diameter approximately equal to the outside diameter of the larger roller section 60. That is, in accordance with the principles of this invention as heretofore described, the extended side shade portions 90, 92 are of such a length that when wrapped about the smaller roller sections 66 and 72 there is formed a substantially smooth transition between the ends 62 and 64 of the larger roller section 60 and the surface of the tubes formed by the wrapping of the shade portions 90 and 92 about the smaller sections with the securement of the center shade portion 88 only to the larger roller section 60 providing the support for the shade across its entire width. Again, in the preferred form, the wrapped portions 90, 92 of the shade are not secured to themselves. Rather, the overlapping wrapped layers frictionally engage each other to prevent drooping of the side shade portions depending from the projecting roller ends.

Provision of opposing telescopingly-seated smaller roller sections and the extended side portions of shade material wrapped thereabout allows the window shade assembly having a transverse symmetrical design, e.g., a scalloped base as illustrated in FIG. 5, to be sized to a window opening without destroying the symmetry. That is, if sizing could only be done from one end of the assembly, then the sizing operation would destroy the symmetry of the design. However, by providing for removal of equal widths of excess shade material from both ends of the assembly, the symmetry of the shade is maintained.

Figure 6:
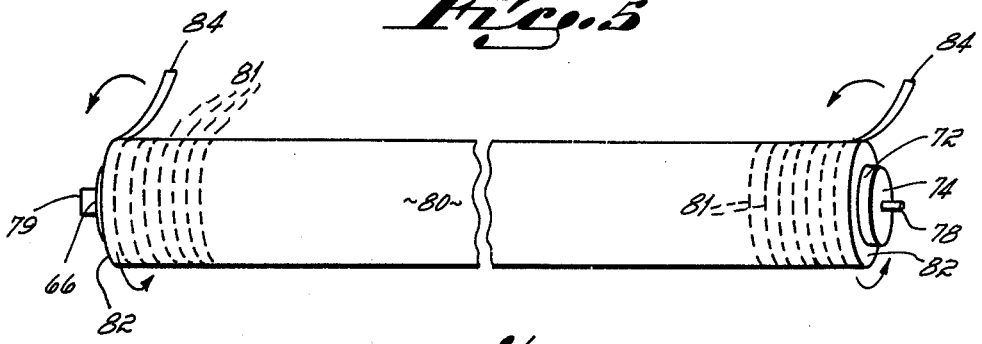
FIGS. 6 and 7 are pictorial views illustrating the steps of sizing the shade shown in FIG. 5.
Figure 7:
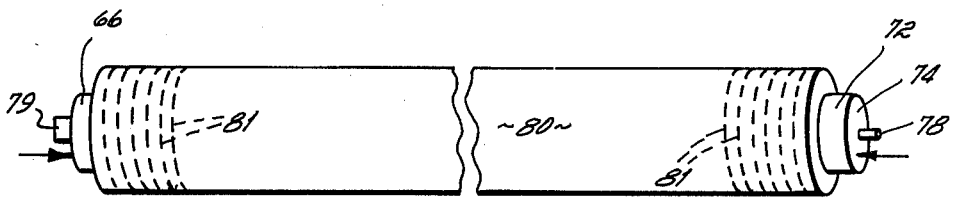

In the sizing operation of the window shade assembly shown in FIG. 5, the amount of excess shade material to be removed is first determined by measuring the window opening or by placing the shade in its rolled position up against the window to mark or otherwise determine the equal widths of the shade material to be removed from both ends. The hem slat, if present, is removed, and the shade is grasped at the hem at the chosen strip line. The shade is unwound along this strip line. This operation is repeated at the opposite end of the shade. (FIG. 6). With both ends stripped of excess shade material, the telescoping smaller roller sections are simply now pushed into the larger roller section to conform to the stripped width of the shade. The hem stick is likewise conformed to the stripped width of the shade and replaced.

This embodiment of the invention thus permits the removal of equal amounts of shade material from each end of the shade assembly to shorten the assembly to conform to a desired window opening while preserving the overall symmetry of the design. It will be appreciated, however, that the shortening operation may be made by stripping excess material from one end only when preserving design symmetry is not required. It will be further appreciated that the advantages of the invention may be realized without providing for hand-stripping of the shade material. That is, the invention is equally applicable where the rolled shade material is separated by cutting through the layers of shade material or the like.

Having described this invention in its presently contemplated best mode, it will be apparent to those of skill in the art that obvious variations may be made in view of the above description to obtain the benefits thereof.

What is claimed is:

1. A window shade assembly comprising, in combination, a telescoping roller including a first tubular roller section, a second tubular roller section having one end thereof telescopingly seated within said first section with a portion thereof projecting axially from said first section, a tube surrounding at least a portion of said second member projecting axially from said first member, and means associated with said roller for resisting relative rotative movement between said tubular roller members, said tube having an inside diameter of the sides permitting free axial sliding movement between said members, and a window shade of flexible sheet material secured along one end to said roller and extending between the ends of said roller and having a free opposite end, said shade having at least at one edge thereof a plurality of spaced hand-strip lines extending from end-to-end substantially parallel to said end such that discrete widths of said shade may be hand-stripped along said lines from said free end of said shade to provide a smooth, straight edge after stripping, said tube being formed by an extended length of shade material wrapped around said projecting portion of said second roller section a number of times sufficient to form an outside diameter approximately equal to the outside diameter of said first roller section, said spaced hand-stripped lines extending to the roller end of said extended length of shade material so as to define when wrapped around said projecting portion of said second roller section a plurality of longitudinally spaced, circumferentially extending strip lines substantially coincident with said lines of said shade, said window shade being adapted to be sized to a window opening by hand-stripping of said discrete widths of said shade from said free end of said shade toward said roller end of said extended length of said shade while said shade is rolled on said roller in a continuous stripping operation.

2. A window shade assembly of claim 1 wherein the overlapping wrapped layers of the extended length of shade material frictionally engage each other.

3. The method of making a window shade assembly comprising the steps of:

providing a telescoping roller having a first tubular roller section, a second tubular roller section having one end thereof telescopingly seated within said first section with a portion thereof projecting axially from said first section, and a window shade of flexible sheet material, said shade having at least at one edge thereof a plurality of spaced hand-strip lines extending from end-to-end; and securing said shade to said roller along an end by securing a first portion of said end to said first section of said roller and wrapping a second extended portion of said end of said shade around said projecting portion of said second roller section a number of times sufficient to form a tube having an outside diameter approximately equal to the outside diameter of said first roller section and including a plurality of longitudinally spaced, cicumferentially extending strip lines substantially coincident with said lines of said shade, said second roller section being freely slidable within said tube such that upon separation of a portion of the side of the shade adjacent said second roller section from the balance of the shade by hand-stripping to form a shade of desired width, said second roller section may be telescoped within said first section to conform to said desired width.

4. The method of claim 3 wherein said first portion of said shade is adhesively secured to said first section of said roller.

5. The method of installing the window shade assembly made in accordance with claim 3, said method comprising the steps of:

marking the desired width of the shade, separating the excess shade material from the balance of the shade material along a line substantially coinciding with the mark by hand-stripping from the free end of the shade toward the roller end, and telescopingly adjusting said roller to conform to said desired width.

* * * * *